United States Patent [19]

Ben-Dov

[11] 4,011,567

[45] Mar. 8, 1977

[54] CIRCULARLY POLARIZED, BROADSIDE FIRING, MULTIHELICAL ANTENNA

[75] Inventor: Oded Ben-Dov, Medford, N.J.

[73] Assignee: RCA Corporation, New York, N.Y.

[22] Filed: Jan. 28, 1976

[21] Appl. No.: 653,035

[52] U.S. Cl. ..... 343/853; 343/895

[51] Int. Cl.[2] ..... H01Q 1/36

[58] Field of Search ..... 343/853, 895, 896

[56] References Cited

UNITED STATES PATENTS 3,503,075 3/1970 Gerst ..... 343/895

*Primary Examiner*—Eli Lieberman

*Attorney, Agent, or Firm*—Edward J. Norton; Robert L. Troike

[57] ABSTRACT

An antenna for radiating substantially circularly polarized signals omnidirectionally about and substantially broadside a support mast is provided by conductors wound about the mast. The conductors are spaced from the mast and are equally distributed about the periphery of the mast with signals coupled to the conductors such that the phase of the signal coupled to one conductor is 180° out of phase with the phase of the signal coupled to adjacent conductors and is in phase with the phase of the signal coupled to the alternate conductor. The number of conductors wound about the mast is selected to be twice the mode number wherein the mode number is the number of 360° linearly phase changes of the electric field in one circumference. The pitch angle of the helically wound conductors and the radius of the helix formed by the conductors is selected to achieve substantially, circularly polarized radiation substantially perpendicular or broadside the lengthwise axis of the mast.

9 Claims, 8 Drawing Figures

PITCH ANGLE IN DEGREES
ψ
80
70
60
50
40
30
.032 .064 .095 .128 .159 .191 .223 .255 .286 .318 .350 .382 .414 .446 .477 .509
a/λ (HELIX RADIUS IN WAVELENGTH)
AXIAL RATIO
A
B
C
D
3.6 dB
MODE 1
2 HELICES
3.4 dB
MODE 2
4 HELICES
3.2 dB
MODE 3
6 HELICES
3.1 dB
MODE 4
8 HELICES

CIRCULARLY POLARIZED, BROADSIDE FIRING, MULTIHELICAL ANTENNA

BACKGROUND OF THE INVENTION

This invention relates to circularly polarized antennas and more particularly to circularly polarized antennas for use in FM radio or in television broadcasting where the antennas are mounted on the top of a support tower and about a support mast which may be of conductive material.

Although horizontally polarized television broadcasting has been almost exclusively used in the United States, it appears from some recent test results that circularly polarized broadcasting might well greatly improve television reception both in large metropolitan areas and in fringe areas.

This invention provides an antenna for broadcasting circularly polarized signals and which, when mounted on a support mast, radiates these signals in an omnidirectional pattern about the mast such that when this mast is erected in the center of a city, for example, substantially equal coverage is provided about the city. The problem of equal coverage about the mast becomes increasingly difficult with conventional antenna systems as the diameter of the mast becomes larger with attendant cloverleaf radiation patterns. These tower diameters tend to become fairly large if the tower itself must be fairly high or support many antenna systems for a plurality of broadcasters. The problem becomes increasingly difficult when this omnidirectional pattern is in the circularly polarized mode.

A low cost antenna for radiating substantially circularly polarized signals over a given range of frequencies omnidirectionally about and substantially broadside a support mast has been provided by four conductors helically wound about and spaced from the mast a given radial distance from the center of the mast with each conductor spaced about 90° of arc about the mast from the adjacent conductors. The conductors are fed with equal power signals at a frequency within the given range of frequencies so that in a plane perpendicular to the axis of the mast the phase of the signal at one conductor is 180° out of phase with the phase of the signal at the two adjacent conductors and in phase with the signal at the alternate conductor. The pitch angle of the conductors for the given radial distance is selected to radiate circularly polarized signals substantially broadside the support mast. An antenna of the type just described is the subject of applicant's application Ser. No. 522,132, filed Nov. 8, 1974, now U.S. Pat. No. 3,940,772 and entitled "Circularly Polarized, Broadside Firing, Tetrahelical Antenna." It is desirable in situations such as when the mast is large that the helix radius be larger and that more than four conductors be distributed about a mast to achieve a substantially circularly polarized and substantially broadside firing antenna.

An elliptically polarized helix antenna is described in a patent No. 3,906,509 to Raymond H. DuHammel entitled "Circularly Polarized Helix Spiral Antennas." This patent discusses elliptically polarized helix antennas and while it suggests that helices be wound about the mast and discusses mode numbers, it requires that in determining the number of helices that 2 M/N should not equal an integer where M = the mode number and N = the number of helices. (See column 10, lines 32 thru 50)

BRIEF DESCRIPTION OF INVENTION

Briefly, a low cost antenna for radiating substantially circularly polarized signals over a given band of frequencies omnidirectionally about and substantially broadside a large support mast which may be of conductive material is provided by a number N of conductors helically wound about and spaced from the mast a given radial distance from the center of the mast with the conductors equally spaced from each other and wound in the same direction about the mast. The conductors are fed equal power signals at a frequency within the given range of frequencies so that in a plane perpendicular to the axis of the mast the phase of the signals at one conductor is 180° out of phase with the phase of the signals at the two adjacent conductors and is in phase with the signals at the alternate conductors. The number N of helices is equal to 2 M where M is an integer greater than 2 and M is the number of 360° linear phase changes of field in one circumference. The pitch angle and the radius of the conductors is selected to radiate a substantially circularly polarized signal substantially broadside the support mast.

DESCRIPTION OF DRAWINGS

A detailed description of a preferred embodiment of the present invention follows in conjunction with the following drawings wherein:

Referring to FIG. 1, there is illustrated a helix current sheath model 10. The mast 11 is considered, but not necessarily, a perfectly conducting core. The sheath 12 about the core 11 is considered to be of an infinite number of helices. The $x$, $y$ and $z$ directions and associated angles $\theta$ and $\phi$ are labeled in FIG. 1. The definition of mode number M as used herein is the number of 360° linear phase changes of the field in one circumference as shown at line 14 with the field varying with azimuth angle $\phi_{AZ}$ in the $x - y$ plane with a constant elevation angle $\theta_{EL}$. The current direction 15 with respect to circumference is the same as the pitch angle $\psi$ of the helix. The current direction follows the helices.

Figure 3:
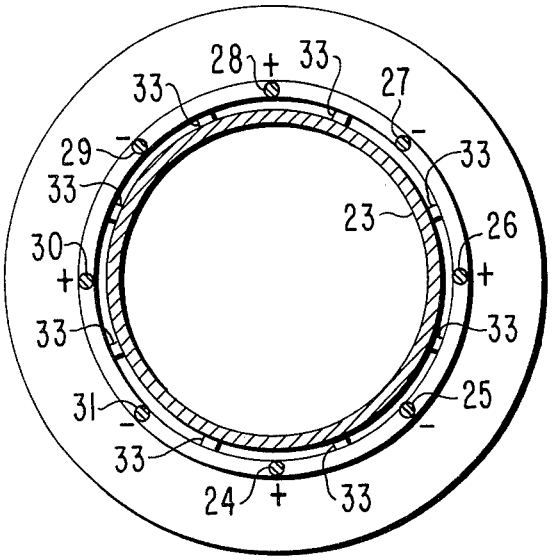
FIG. 3 is a sketch taken along lines 3 — 3 in FIG. 2 illustrating the relative phases of the signals on the helical conductors and the radius of the helices.
Figure 2:
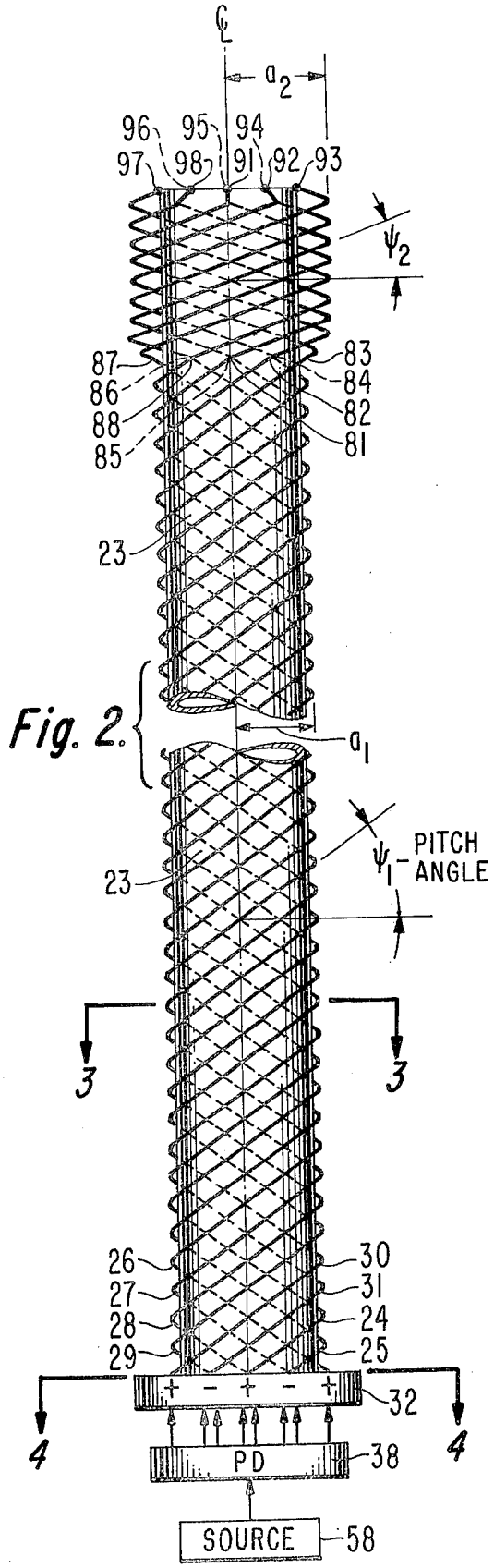
FIG. 2 is an elevation view of an antenna system according to a first preferred embodiment of the present invention.

In actual practice the infinite sheath helix is replaced by a finite number of helical conductors which spiral about a support mast 23 as shown in FIGS. 2 and 3. The mode number M remains the same as for the infinite wire helix and is dependent upon the phase of the feed voltages applied to the conductors. In the example illustrated in FIGS. 2 and 3, eight helical conductors 24, 25, 26, 27, 28, 29, 30 and 31 are wound about support mast 23 at given pitch angles $\psi_1$ and $\psi_2$. The helical conductors 24 thru 31 are equally spaced from each other about the mast 23 with the conductors spaced equally from the mast by dielectric spacers 33.

Figure 1:
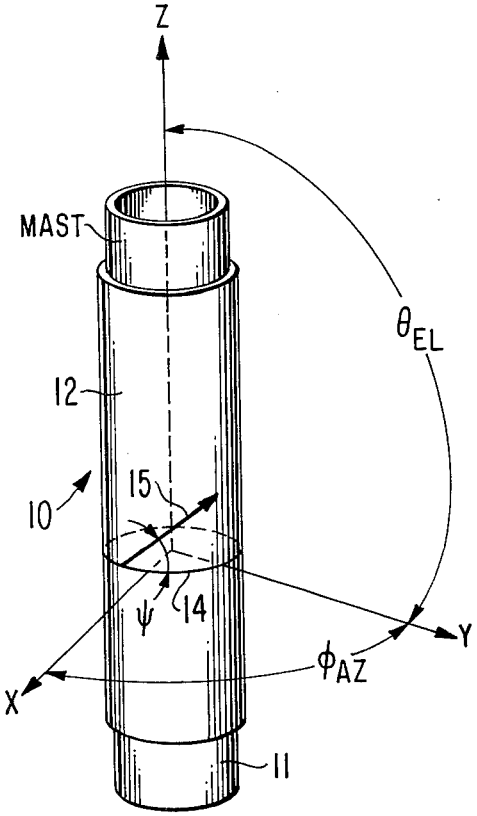
FIG. 1 is a helix current sheath model of an antenna useful in explaining the definition of mode number.

The helical conductors 24 thru 31 are fed at the bottom end. According to the teaching herein the number of helices N is equal to 2 times the mode number where M is an integer. Since there are eight helices, the mode number $M = 4$. Thus, if in transversing the circumference as shown at line 14 in FIG. 1, the phase of the field progresses by 1440 $(360° \times 4)°$. This phase progression is achieved by feeding the alternate conductors 24, 26, 28 and 30 in phase (0° for example indicated by $a +$ in FIG. 3) and the alternate conductors 25, 27, 29 and 31 180° out of phase (180° for example indicated by a - in FIG. 3). This is assuming that the helical conductors are fed in the same plane transverse to helical axis or mast axis. The conductors 24 thru 31 are fed with equal voltages via the feed 32 and power divider 38 from a common source 58.

Figure 4:
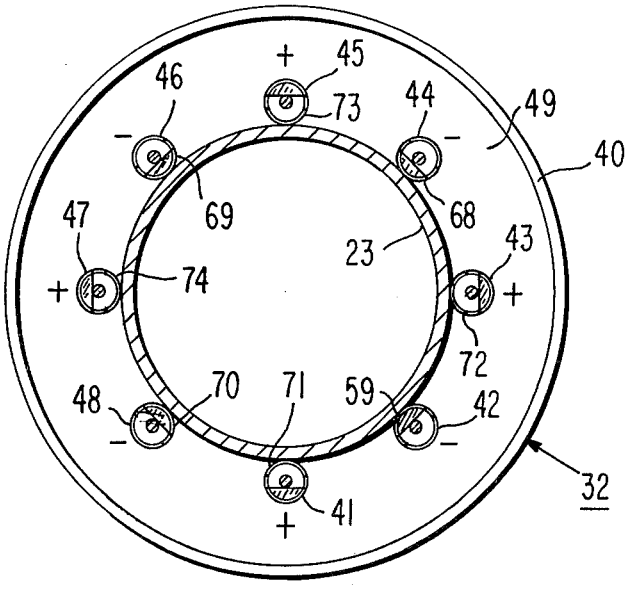
FIG. 4 is a sketch of the feed system taken along lines 4 — 4 in FIG. 2.
Figure 5:
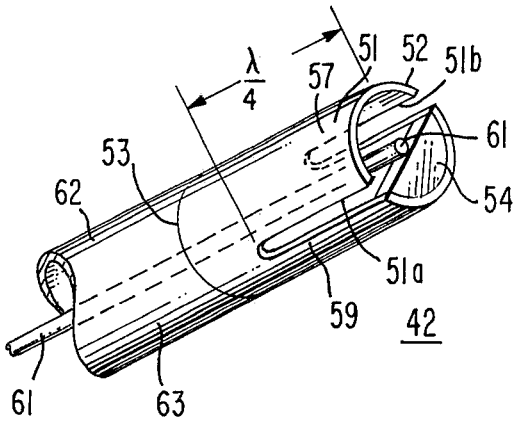
FIG. 5 is a perspective view of one of the baluns in FIG. 4.

To achieve this relative phase relationship the feed 31 may be like the system illustrated in FIGS. 4 and 5. A cylindrical shield 40 having bottom and side walls encloses the feed system 32. Inside the shield 40 are eight baluns 41, 42, 43, 44, 45, 46, 47, and 48 spaced 45° of arc from each other about the conductive mast 23 at the bottom end. The mast 23 at the bottom end extends through the center of the shield 40. The balun 42 for example is made of a section 51 of conductive tubing that extends at end 53 to the bottom wall 49 of the shield 40. The section 51 has two slits 51*a* and 51*b* that extend one quarter wavelength long at the operating frequency of the antenna from the end 52 to form an upper half 57 and a lower half 59 near the end 52. The lower half 59 is filled near the end 52 with a body 54 of conductive material. A coaxial transmission line 63 is coupled to end 53 of the balun 42 with the outer conductor 62 of this coaxial transmission line 63 connected to section 51 at the end 53 of the balun 42 and the bottom wall 49 of shield 40. The center conductor 61 of the transmission line extends in insulative manner through the center of the section 51 of the balun 42 and makes contact with lower half 59 at end 52 via body 54. The baluns 41 and 43 thru 48 are similar to the balun 42. The half 59 of balun 42 connected to the center conductor 61 of the coaxial feed line 63 is connected to the mast 23. Similarly the half 68 of the balun 44 connected to its center conductor, the half 69 of balun 46 connected to its center conductor, and the half 70 of balun 48 connected to its center conductor is connected to mast 23. The halves 71 thru 74 of the respective baluns 41, 43, 45 and 47 that are not directly connected to the center conductor of their feed lines are connected to the mast 23. The outboard halves of the baluns 41 thru 48 that are not directly connected to the mast 23 are connected to the conductors 24 thru 31 respectively. The input power to the eight coaxial lines feeding the baluns should be equal. This may be provided by an eight way power divider 38 coupled between the signal source 58 and the eight baluns 41 through 48 in feed 32.

In the arrangement illustrated in FIGS. 2 and 3, the conductors 24 thru 31 are wound four turns about the mast 23 at a constant pitch angle $\psi_1$ between feed points at the baluns 41 thru 48 and points 81 thru 88. The conductors 24 thru 31 extend about one turn beyond points 81 thru 88 to the ends 91 thru 98 respectively, at a second constant pitch angle $\psi_2$. The ends 91 thru 98 are terminated to the mast 23. This pitch angle $\psi_1$ and $\psi_2$ as illustrated in FIG. 2, is the angle of the slope of the coil (the vertical projection) relative to the axis perpendicular to the lengthwise axis of the mast 23.

Figure 6:
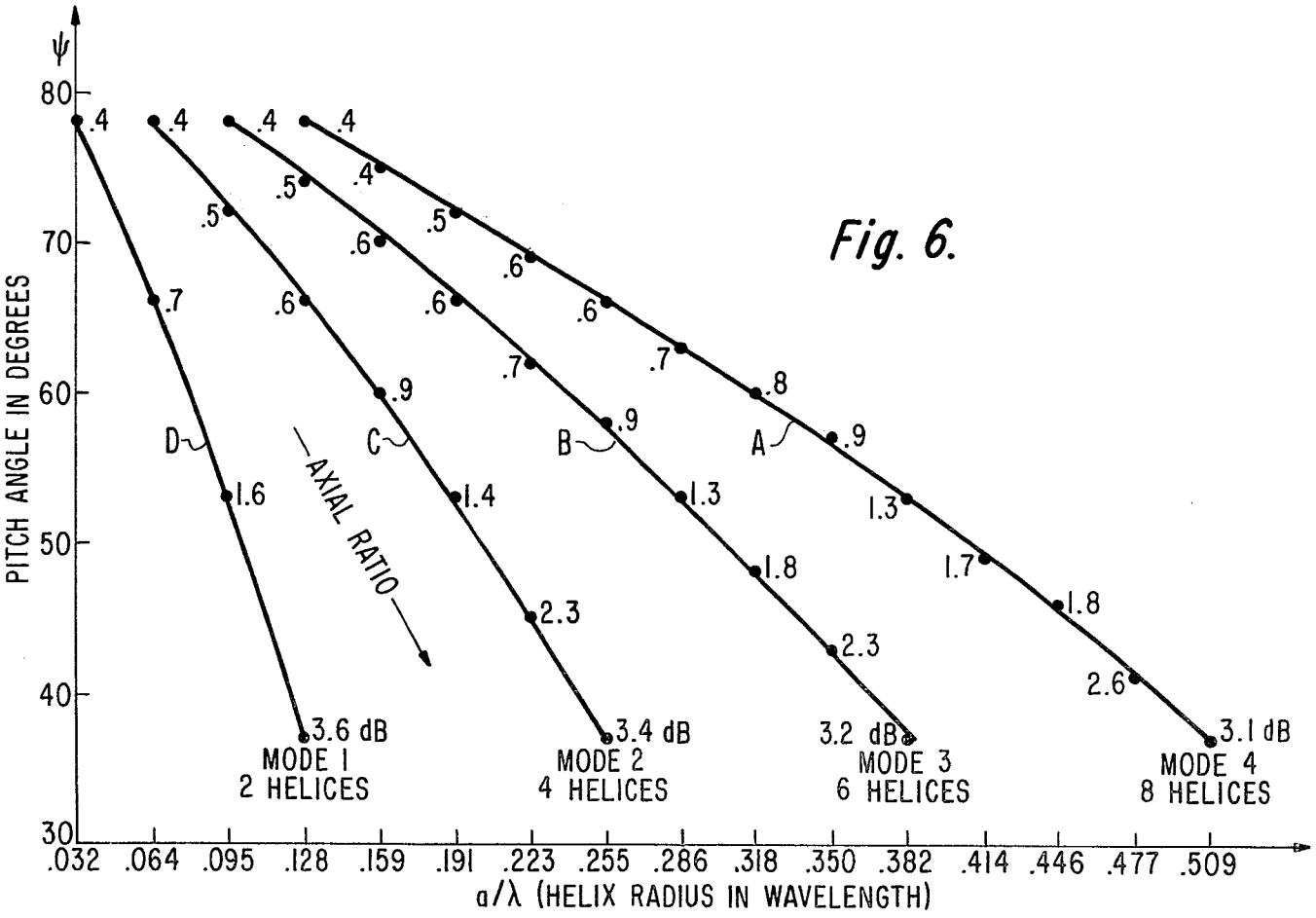
FIG. 6 is a plot of pitch angle in degrees vs. radius of the helices in wavelengths as a solution of equation $M = ka/\cos\psi$

The pitch angle $\psi$ and the radius (a) are chosen relative to the mode number to achieve substantially circularly polarized radiation substantially broadside the axial direction of the helical conductors. According to the teaching herein for broadside firing condition $M = \gamma a/\cos\psi$, where M is the mode number as defined previously and equals $N/2$, N equals the number of helices, $\gamma$ is the propagation constant, a is the radius of the helices and $\psi$ is the pitch angle of the helical conductors. Since the propagation constant $\gamma$ for the arrangements of helical conductors spaced from a mast as shown is approximately equal to the free space propagation constant where $k = 2\pi/\lambda$, it is assumed $k = \gamma$ in the equations herein. Therefore for the broadside firing condition, $M = ka/\cos\psi$. If the number N of helices is eight for example the mode number is 4. FIG. 6 is a plot of a solution of the equation $M = ka/\cos\psi$. Curve A is the solution for eight helices in mode 4. The numbers on the curve indicate axial ratio in *db*. The axial ratio imposed by the solution above is solved by the following equation $$AR = 20 \log \left[ 2 \tan \Psi \frac{J_m(ka)}{J_{m-1}(ka)} \right],$$

where $k$, $a$ and $\psi$ are as defined above and, $J_m$ is a Bessel function of the order of M, the mode number.

In Curve A of FIG. 6, the axial ratio when the broadside condition is satisfied varies between 0.4 and 3.1 *db*. The lower the axial ratio the more pure the circular polarization. As can be seen for the eight helices case when operated at mode 4, the broadside condition is satisfied and minimum elipticity is achieved when the helix radius equals approximately 0.159 wavelengths and the pitch angle is about 75°. Circular polarization (where the axial ratio equals one or zero *db* in FIG. 6) with the signal transmitted generally but not exactly broadside is achieved according to the teaching herein when $$\Psi = \tan^{-1} \left[ \frac{J_{m-1}(ka)}{2J_m(ka)} \right]$$

where $k$, $a$, and $\Psi$ are as described above and $J_m$ is a Bessel function of the order of M.

Figure 7:
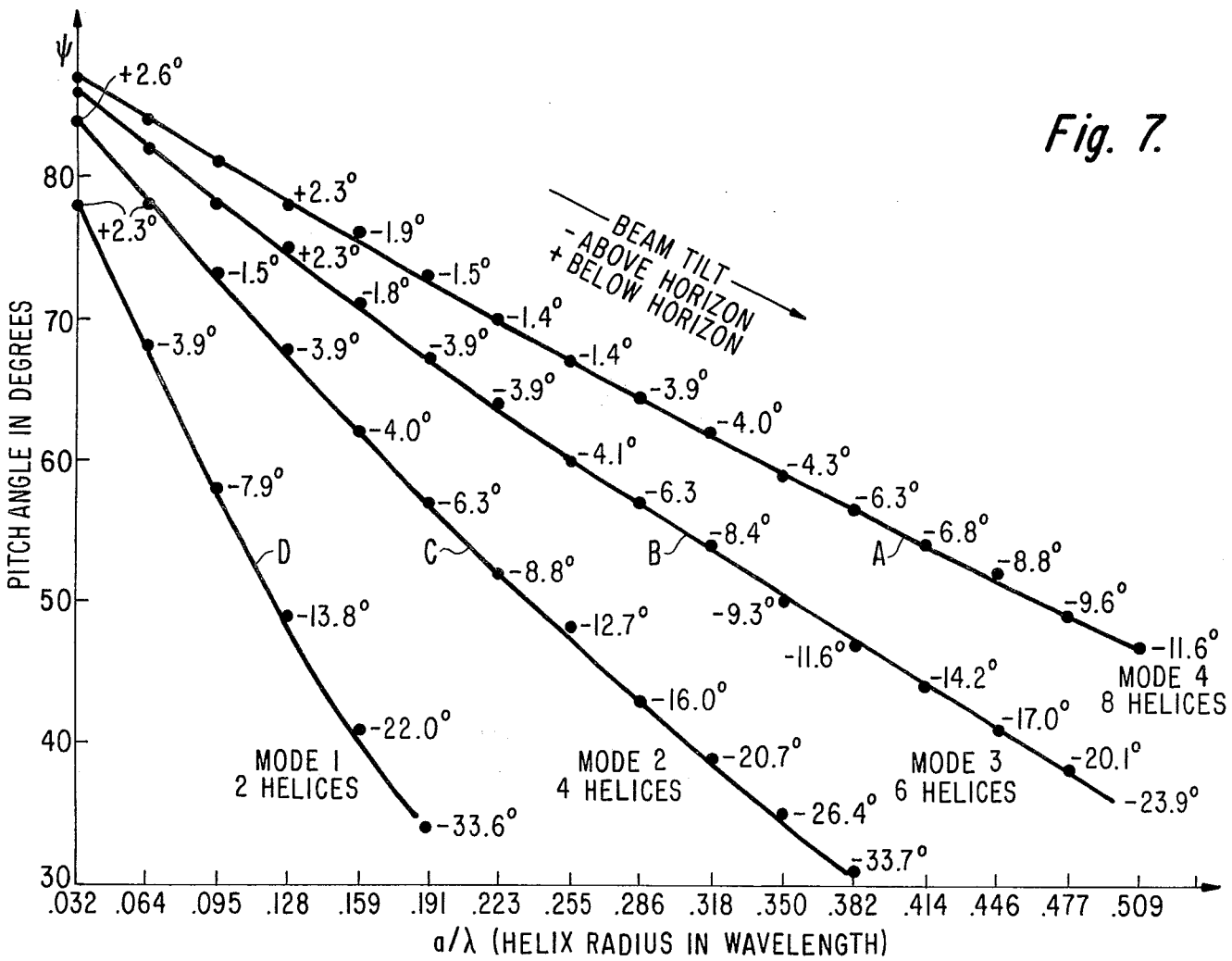
FIG. 7 is a plot of pitch angle in degrees vs. the radius of the helices in wavelengths as a solution to equation $$\Psi = \tan^{-1}\left[\frac{J_{m-1}(ka)}{2J_m(ka)}\right], \text{ and}$$

FIG. 7 is a plot of a solution of this equation where $J_m$ is a Bessel function of the order of the mode number. Curve A in FIG. 7 is the solution for eight helices in mode 4. The beam tilt above and below the horizon imposed by the solution above is solved by the following equation:

$$\Theta = \mathrm{Cos}^{-1}\left[\frac{1}{\sin \Psi}\left(1 - \frac{M\mathrm{Cos}\,\Psi}{ka}\right)\right] \text{ degrees}$$

In FIG. 7, the plus symbol indicates a beam tilt below the horizon and a minus symbol indicates the degree of beam tilt above the horizon. Curve A indicates that pure circular polarized waves (axial ratio of one) can be achieved with slight beam tilts (slightly off broadside) with the helix radius in wavelengths varying between 0.032λ and 0.509λ and pitch angles varying from 30° to 80°, It is seen, however, that broadside radiation would be provided with the radius somewhere between 0.128 and 0.159 wavelengths and the pitch angle $\psi$ about 75. With reference to curve A, a solution can be found to achieve circular polarization with the most desirable radiation beam direction. The curves of FIG. 6 and FIG. 7 may be compared to find those values of pitch angle $\psi$ and radius a of helices to achieve minimum axial ratio and minimum beam tilt or the most desirable beam tilt.

For an example of an eight helices antenna system, the helical conductors can be about three-eighths inch diameter, the pitch angle $\psi_2$ selected is 55° and radius $a_2$ about 0.368λ. The pitch angle $\psi_1$, is about 75° and the radius $a_1$ is about 0.159λ.

Figure 8:
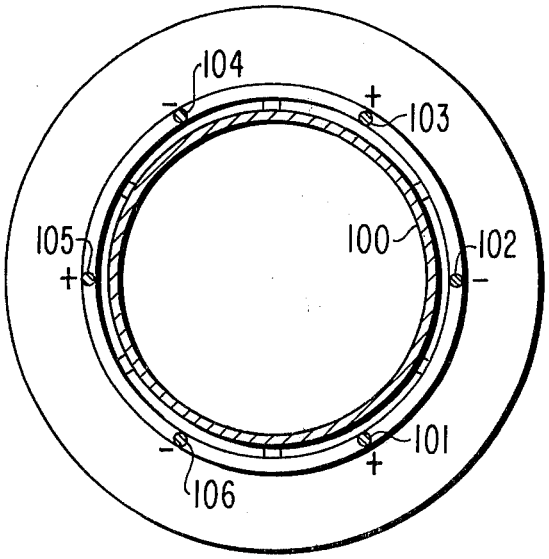
FIG. 8 is a cross-sectional view of an antenna according to a second embodiment of the present invention.

Referring to FIG. 8, there is illustrated a cross-sectional view of six helical conductors 101 thru 106 spaced around a support mast 100. The conductors are equally spaced from each other and from the mast. The conductors 101 through 106 spiral around the mast at a constant pitch angle for four turns and then spiral an extra turn at a lower pitch angle. The conductors are connected to the mast at the end opposite the feed end. The feed is similar to the feed 32 in FIG. 4 with only six baluns. The system for six helical conductors operates in mode 3 with the conductors 101, 103, and 105 fed with equal voltage signals in phase (0° phase for example indicated by + in FIG. 8) and the alternate helical conductors 102, 104 and 106 fed in phase with each other and 180° out of phase (180° phase for example indicated by - in FIG. 8) with the helical conductors 101, 103 and 105. The radius is greater than that of the mast and is selected together with the pitch angle so as to approximate the solution $$\Psi = \tan^{-1}\left[\frac{J_2\,(ka)}{2J_2\,(ka)}\right]$$

which is plotted on curve B of FIG. 7. Also the radius and pitch angle is selected to approximate the solution $3 = ka/\cos\psi$ which is plotted on curve B of FIG. 6.

Applicant's prior application Ser. No. 522,132 filed Nov. 8, 1974 presented a solution for the four helices case. Curve C of FIG. 6 presents a solution for the mode 2 case with four helical conductors of $ka/\cos\psi = 2$. Curve C of FIG. 7 presents a solution for the mode 2 case with four helical conductors of $$\Psi = \tan^{-1}\left[\frac{J_1\,(ka)}{2J_2\,(ka)}\right].$$

Curve D of FIG. 6 presents a solution for the mode 1 case with two helices of $ka/\cos\psi = 1$. Curve D of FIG. 7 presents a solution for the mode 1 case with two helical conductors of $$\Psi = \tan^{-1}\left[\frac{J_0\,(ka)}{2J_1\,(ka)}\right]$$

where $J_0$ is a Bessel function of the order of zero.

What is claimed is:

1. An antenna for radiating substantially circularly polarized signals over a given band of frequencies omnidirectionally about and substantially broadside a support mast comprising:

a number N of conductors helically wound about and spaced from the support mast a given radial distance from the support mast with said conductors equally spaced from each other and wound in the same direction about the mast, means for coupling equal power signals at the same frequency within said given band of frequencies to said conductors so that in a plane perpendicular to the axis of the mast the phase of the signals at one conductor is 180° out of phase with the phase of the signals at the two adjacent conductors and is in phase with the signals at the conductor alternate therefrom and so that the number of 360° linear phase changes is equal to one-half the number N of helices, said conductors extending at a pitch angle and in a given radial distance approximating the following relationship:

$$M = \frac{ka}{\cos\psi}$$

where $M = ½$ N the number of helices $k = 2\pi/\lambda$ where λ is measured at a frequency within said given band of frequencies, $a$ = the radius of the helix, $\psi$ is the pitch angle of the helices, and N is greater than 4 and is an even integer.

2. The combination of claim 1 wherein $N = 8$ and $M = 4$.

3. The combination of claim 1 wherein $N = 6$ and $M = 3$.

4. An antenna for radiating substantially circularly polarized signals over a given band of frequencies omnidirectionally about and substantially broadside a support mast comprising:

a number N of conductors helically wound about and spaced from the support mast a given radial distance from the support mast with said conductors equally spaced from each other and wound in the same direction about the mast, means for coupling equal power signals at the same frequency within said given range of frequencies to said conductors so that in a plane perpendicular to the axis of the mast the phase of the signals at one conductor is 180° out of phase with the phase of the signals at the two adjacent conductors and is in phase with the signals at the conductor alternate therefrom and so that the number of 360° linear phase changes is equal to one-half the number N of helices, said conductors extending at a pitch angle and in a given radial distance approximating the following relationship:

$$\Psi = \tan^{-1}\left[\frac{J_{m-1}(ka)}{2J_m(ka)}\right]$$

where $k = 2\pi/\lambda$ where $\lambda$ is at a frequency within said given range of frequencies $a$ = the radius of the helices $J_M$ = the Bessell function of the order of M M = ½ the number N of helices, and N is even and greater than 4.

5. The combination of claim 4 where $N = 8$ and $M = 4$.

6. The combination of claim 4 where $N = 6$ and $M = 3$.

7. An antenna for radiating substantially circularly polarized signals over a given band of frequencies omnidirectionally about and substantially broadside a support mast comprising:

a number N of conductors helically wound about and spaced a given radial distance from the support mast with said conductors equally distributed about the periphery of the mast and wound in the same direction about the mast, means for coupling equal power signals at the same frequency within said given range of frequencies to said conductors so that in a plane perpendicular to the axis of the mast the phase of the signals at one conductor is 180° out of phase with the phase of the signals at the two adjacent conductors and is in phase with the signals at the conductor alternate therefrom and so that the number of 360° linear phase changes is equal to one-half the number N of helices, said conductors extending at a pitch angle and in a given radial distance approximating the following relationship:

$$M = \frac{ka}{\cos\Psi} \text{ and}$$

$$\Psi = \tan^{-1}\left[\frac{J_{m-1}(ka)}{2J_m(ka)}\right]$$

where $M$ = ½ N the number of helices $k = 2\pi/\lambda$ where $\lambda$ is measured at a frequency within said given range of frequencies, $a$ = the radius of the helix and $\psi$ is the pitch angle of the helices, where N is even and greater than 4 and $J_M$ = the Bessel function of the order of M.

8. The combination of claim 7 $N = 8$ and M = 4.

9. The combination of claim 7 wherein $N = 6$ and $M = 3$.

* * * * *

UNITED STATES PATENT OFFICE
CERTIFICATE OF CORRECTION

PATENT NO. : 4,011,567

DATED : March 8, 1977

INVENTOR(S) : Oded Ben-Dov

It is certified that error appears in the above-identified patent and that said Letters Patent are hereby corrected as shown below:

In Column 5, line 50, that portion of the equation reading

"$2J_2$ (ka)" should read -- $2J_3$ (ka) --

Signed and Sealed this

Twenty-first Day of June 1977

[SEAL]

*Attest:*

RUTH C. MASON
*Attesting Officer*

C. MARSHALL DANN
*Commissioner of Patents and Trademarks*